United States Patent [19]

Scharpey et al.

[11] Patent Number: 4,683,046

[45] Date of Patent: Jul. 28, 1987

[54] REDUCTION POT FOR THE PRODUCTION OF ALUMINUM

[75] Inventors: Wilhelm Scharpey, Essen, Fed. Rep. of Germany; Rudolf Pawlek, Sierre, Switzerland

[73] Assignee: Swiss Aluminium Ltd., Chippis, Switzerland

[21] Appl. No.: 840,594

[22] Filed: Mar. 17, 1986

[30] Foreign Application Priority Data

Mar. 22, 1985 [CH] Switzerland ..... 1275/85

[51] Int. Cl.[4] ..... C25C 3/08

[52] U.S. Cl. ..... 204/243 R; 204/294

[58] Field of Search ..... 204/243 R-247, 204/67, 294, 286

[56] References Cited

U.S. PATENT DOCUMENTS

| | | | |
|---|---|---|---|
| 3,764,509 | 10/1973 | Etzel et al. | 204/243 R |
| 3,867,562 | 2/1975 | Fischer et al. | 204/286 X |
| 4,033,836 | 7/1977 | Holmes | 204/243 R X |
| 4,076,610 | 2/1978 | Bizzarri | 204/294 X |
| 4,118,304 | 10/1978 | Arita | 204/243 R |
| 4,430,187 | 2/1984 | Snaeland et al. | 204/294 X |

*Primary Examiner*—Donald R. Valentine

*Attorney, Agent, or Firm*—Bachman & LaPointe

[57] ABSTRACT

An aluminum reduction cell having an outer steel shell, thermal and electrical insulation, and an inner lining comprising at least a floor and sidewalls, the improvement which comprises a gap sealant at least in the region of the transition between the floor and sidewalls, the gap sealant comprises a pourable material characterized by a melting point of greater than 1000° C., a density of greater than 2.7 g/cm$^3$ and a high degree of resistance to molten electrolyte and molten aluminum.

6 Claims, 5 Drawing Figures

REDUCTION POT FOR THE PRODUCTION OF ALUMINUM

The invention relates to a reduction pot for the production of aluminum by the fused salt electrolytic process in which the reduction pot comprises an outer steel shell, thermal and electrical insulation, and an inner lining that is essentially of carbon and contains iron cathode bars.

In the production of aluminum by fused salt electrolytic reduction of aluminum oxide, the latter is dissolved in a fluoride melt comprised for the greater part of cryolite. The cathodically precipitated aluminum collects under the fluoride melt on the carbon floor of the cell, the surface of the molten aluminum there forming the actual cathode. Dipping into the melt from above are anodes which in conventional processes are of amorphous carbon. Oxygen is produced at the carbon anodes as a result of the electrolytic decomposition of the aluminum oxide; this oxygen combines with the carbon of the anodes to form $CO_2$ and CO. The electrolytic process takes place in a temperature range of about 940°–970° C.

The inner lining of the reduction pot is made up of prebaked carbons blocks with one or two iron cathode bars embedded in them. These cathode blocks, or carbon floor elements as they can be called, are joined together during the assembly of the cell by means of a green strength, carbonaceous ramming mass, or in accordance with another method by adhesive bonding. Normally, the floor of the carbon lining is fitted at the sides with sidewall bricks or tiles which are likewise of pre-baked carbonaceous material. The connection between the cathode blocks and the sidewall bricks or tiles is made such that the gap between these shaped components is filled with the above mentioned ramming mass.

The places where the said shaped components and the ramming mass meet always represent weaknesses in the carbon lining. The considerable shrinkage that takes place during the calcining of the ramming mass means that there is a tendency for the ramming mass to separate from the shaped components of the lining. This leads to cracks in the ramming mass or even to the ramming mass separating from the shaped lining components. This then enables the molten aluminum and/or the electrolyte to penetrate the carbon lining and possibly to reach the iron cathode bars. A chemical reaction between the aluminum and the cathode bars can even lead to a partial dissolution of the latter. The flow of electric current through the cell is consequently markedly hindered; operating problems and finally shutting down of the whole cell can be the result.

In the U.S. Pat. No. 4,076,610 an attempt has been made to provide better protection for the cathode bars against corrosive attack by the electrolyte and molten aluminum salts. This is achieved on the one hand by not using cast iron and fitting the cathode bars to the carbon floor elements already during the production of the carbon blocks, and by joining these securely together with their own material without the use of cast iron or ramming mass. On the other hand the carbon floor elements used according to the U.S. Pat. No. 4,076,610 are made in one piece together with the sidewall tiles.

The object of the present invention is to significantly reduce the penetration of molten aluminum or electrolyte into the inner carbon lining of a reduction pot and thus also the related inevitable destruction of the iron cathode bars, at the same time without the means employed to this end significantly affecting the cost of manufacturing the reduction pot.

SUMMARY OF THE INVENTION

The foregoing object is achieved by way of the present invention in that, at least in the region of the inner pot surface at the transitions from carbon to carbon or from carbon to another material, use is made of a gap sealant comprising a pourable material that, at the cell operating temperature, is resistant to the molten electrolyte and molten aluminum, has a melting point above 1000° C. and a density of over 2.7 g/cm$^3$.

The density of over 2.7 g/cm$^3$ is clearly necessary in order that the gap sealant can not float in molten aluminum.

In order that the flow of electric current from aluminum into the floor of the carbon lining is not disturbed i.e. to avoid a higher electrical resistance, the gap sealant must be limited to the particularly vulnerable regions. For this reason groove-like recesses are provided in the carbon and/or other material at the transitions, preferably on one or both sides of the joint, in order that the sealant can be pressed in. This concerns in particular the transitions from the sidewall ramming mass to the carbon floor elements, from the sidewall ramming mass to the sidewall bricks or the insulation, and/or from carbon floor element to carbon floor element. Transitions in the form of gaps can be filled with gap sealant mass up to the full height. In practice, however, it suffices if at least the uppermost 5 cm, i.e. the 5 cm bordering on the inner surface of the carbon pot, is of gap sealant material. The lower part can then be filled with the usual ramming mass or also with ground residual insulation material.

With due regard to the economic aspect, the following materials in particular satisfy the requirements demanded of the gap sealant:

Calcium oxide, magnesium oxide, barium oxide, calcium fluoride, magnesium fluoride, barium fluoride, silicon oxide, iron-III-oxide, silicon carbide, titanium nitride, boron nitride, chromium-III oxide and aluminum oxide.

These materials can be employed as gap sealant either singly or mixed with at least one of the other above mentioned materials. Although, for example, titanium diboride can also meet the set technical requirements, it can not be used to advantage from the standpoint of economics.

The materials used as gap sealant are preferably in powder form. In that form they can be mechanically compacted for example in a groove-like recess at the place of use, especially making use of vibration or ramming.

The arrangement of a gap sealant according to the invention provides the following main advantages:

- There are fewer or no cracks or air gaps for the molten electrolyte and aluminum to penetrate.
- The carbon lining of the reduction pot holds together better and therefore has a longer service life, which provides significant financial advantage.
- The gap sealant can be employed along with cold and also with hot ramming masses.
- The floor and sidewall lining of shaped carbon blocks can be joined together directly without sidewall ramming mass, in the same way as the individual carbon floor elements.

BRIEF DESCRIPTION OF THE DRAWINGS

The invention is explained in the following by way of examples. Schematic vertical sections or partial sections are shown in the drawings wherein, FIG. 1. A partial cross-section of a reduction pot with conventional carbon floor elements.

DETAILED DESCRIPTION

Figure 1:
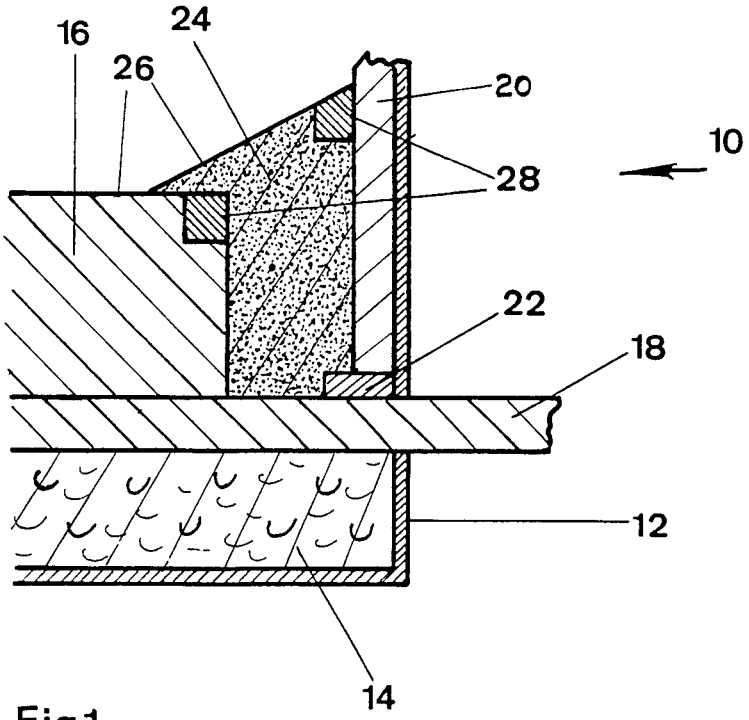

The reduction pot 10 shown in a partial section in FIG. 1 features an outer steel shell 12 which is fitted at the bottom with a layer 14 of insulation, and lying horizontal on that, the carbon floor elements 16 containing the iron cathode bars 18. The carbon floor elements 16 are of amorphous carbon, semi-graphite or graphite. The iron cathode bar 18 is rammed-in, cast-in, adhesively bonded or clampfitted in place.

Arranged at the side of the reduction pot 10 is a sidewall brick 20 which is made of carbon. This sidewall brick 20 is separated from the sidewall of the steel shell 12 by an electrically insulating layer, which is not shown here, and rests on a layer of firebrick 22.

The gap between the carbon floor elements 16 and the sidewall bricks 20 or firebricks 22 is filled with a sidewall ramming mass 24 and forms a sloping part of the sidewall.

In the region of the pot surface 26 the transitions between the sidewall ramming mass 24 and the carbon floor elements 16 and the sidewall bricks 20 are each protected by a gap sealant 28. This is arranged in groove-like recesses that run in the shaped blocks in the longitudinal direction of the reduction pot.

Figure 2:
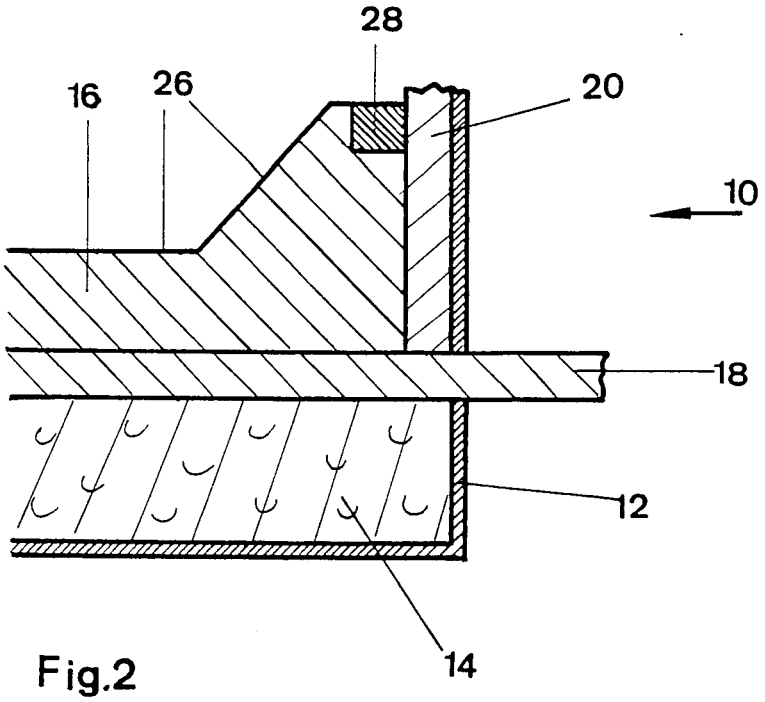
FIG. 2. A partial cross-section of a reduction pot with monolithic carbon floor elements and sidewall tiles.

In the version shown in FIG. 2 between the silicon carbide sidewall brick 20 and the monolithic carbon floor element 16 there is no gap filled with sidewall ramming mass (24 in FIG. 1). For this reason it is necessary only to protect the transition between the sidewall brick 20 and the side region of the carbon floor element 16. This is achieved with a powder gap sealant 28 situated in a groovelike recess in the carbon floor element 16 where it is also mechanically compacted into place. The groove-like recess for the gap sealant 28 can have a sidewall length of 5–10 cm and can be square or rectangular in cross-section.

Figure 3:
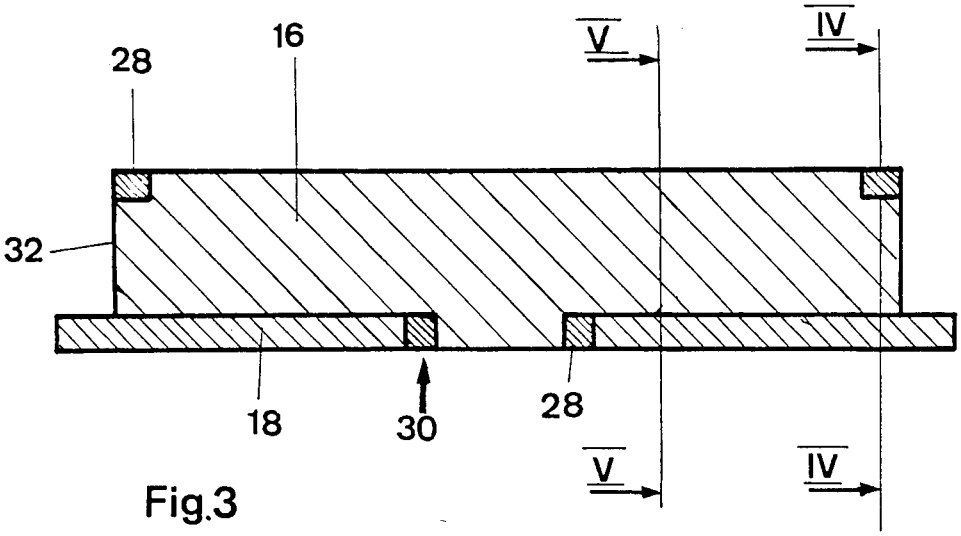
FIG. 3. A longitudinal section through a carbon floor element.

The carbon floor element 16 shown in FIG. 3 contains two iron cathode bars 18 separated at the middle by a distance from each other. The channels made in the carbon floor element 16 for the cathode bars 18 are extended somewhat towards the middle, as a result of which expansion gaps 30 are created. These are filled with gap sealant material 28 which is in the form of a powder.

In the uppermost region of each endwall 32 of the carbon floor element 16 is a recess for the gap sealant powder 28.

Figure 4:
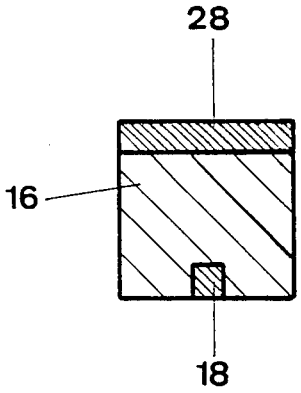
FIG. 4. A cross-section along IV—IV in FIG. 3.

The vertical cross-section in FIG. 4, made in the region of the endwall 32 of the carbon floor element 16, runs through the gap sealant 28 which likewise runs in the transverse direction. The vertical cross-section in FIG. 5 shows the gap sealant 28 in the longitudinal direction of the carbon floor element 16.

Figure 5:
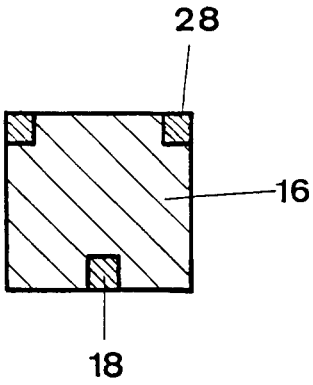
FIG. 5. A cross-section along V—V in FIG. 3.

If the carbon floor elements 16 in FIGS. 3–5 are joined together, for example by adhesive bonding, then

- gap sealant 28 runs longitudinally on both sides of the reduction pot 10, said sealant comprising the gap sealants 28 situated at the ends 32 of the carbon floor elements 16,
- gap sealant 28 runs on both endwalls 32 of the reduction pot 10, each said sealant being formed by a carbon floor element 16 situated at the end, and
- gap sealant 28 which runs between pairs of carbon floor elements 16.

All gap sealants 28 border on the inner surface of the carbon lining.

Of course the gap sealants 28 can, according to other versions, be omitted for example between the carbon floor elements 16.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An aluminum reduction cell having an outer steel shell, thermal and electrical insulation, and an inner lining comprising at least a floor formed of a plurality of carbon blocks and sidewalls, the improvement which comprises a gap sealant at least in the region of the transition between the carbon blocks of the floor and the floor and sidewalls so as to prohibit penetration of the contents of the reduction cell into the inner lining of the reduction cell, the gap sealant comprises a pourable material characterized by a melting point of greater than 1000° C., a density of greater than 2.7 g/cm$^3$ and a high degree of resistance to molten electrolyte and molten aluminum.

2. An aluminum cell according to claim 1 wherein, in the region of the transition, on both sides thereof groove-like recesses are provided, said recesses being filled with the gap sealant.

3. An aluminum reduction cell according to claim 1 wherein a ramming mass is provided between said floor and said sidewalls wherein the transition between the sidewall ramming mass and floor and between the sidewall ramming mass and sidewalls are provided with gap sealants at least in the region of the uppermost 5 cm.

4. An aluminum cell according to claim 1 wherein the gap sealant comprises a material selected from the group consisting of calcium oxide, magnesium oxide, barium oxide, calcium fluoride, magnesium fluoride, barium fluoride, silicon oxide, iron-III oxide, silicon carbide, titanium nitride, boron nitride, chromium-III oxide, aluminum oxide and mixtures thereof.

5. An aluminum reduction cell according to claim 1 wherein the gap sealant is in powder form.

6. An aluminum reduction cell according to claim 5 wherein the gap sealant is mechanically compacted.

* * * * *